US006940395B2

(12) United States Patent
Steinmark

(10) Patent No.: US 6,940,395 B2
(45) Date of Patent: Sep. 6, 2005

(54) SYSTEM AND METHOD FOR CREATING AN ADJUSTED ALARM TIME

(75) Inventor: Daniel E Steinmark, Flanders, NJ (US)

(73) Assignee: Intel Corporation, Santa Clara, CA (US)

( * ) Notice: Subject to any disclaimer, the term of this patent is extended or adjusted under 35 U.S.C. 154(b) by 635 days.

(21) Appl. No.: 09/895,356

(22) Filed: Jun. 29, 2001

(65) Prior Publication Data

US 2003/0001727 A1 Jan. 2, 2003

(51) Int. Cl.[7] ..... G08B 1/00

(52) U.S. Cl. ..... 340/309.16; 340/905; 340/60; 340/539.1; 340/5.5; 340/5.85; 340/995.21; 340/995.13

(58) Field of Search ..... 340/309.16, 601, 340/505, 539.1, 5.8, 5.85, 995.13, 995.21, 905, 256.02, 256.06; 379/90.01

(56) References Cited

U.S. PATENT DOCUMENTS 5,802,158 A * 9/1998 Jeong ..... 379/198
5,832,067 A * 11/1998 Herold ..... 379/110.01
6,229,430 B1 * 5/2001 Smith Dewey ..... 340/286.02

* cited by examiner

*Primary Examiner*—Julie B. Lieu
(74) *Attorney, Agent, or Firm*—Pillsbury Winthrop LLP

(57) ABSTRACT

A system and method for adjusting an alarm/reminder activation time that takes into account a user-requested alarm/reminder time and unexpected conditions that are unknown to the user, or are realized after the user has entered the user-requested alarm time, is provided. User related information is used to gather present unexpected condition information relevant to the user from a content provider periodically. Based on the user related and configuration information and the unexpected condition information, an adjusted alarm time is determined periodically. An alarm signal is activated when the actual time reaches the adjusted alarm time.

34 Claims, 10 Drawing Sheets

SYSTEM AND METHOD FOR CREATING AN ADJUSTED ALARM TIME

BACKGROUND OF THE INVENTION

1. Field of the Invention

The present invention generally relates to an alarm system and, more particularly, to a system and method for adjusting the time for creating an alarm signal based upon a user-requested alarm time and an unexpected condition(s), such as local weather, local traffic, and airplane arrival or departure time.

2. Discussion of the Related Art

Currently, there are alarm systems in the form of alarm clocks and wake up call services. A rudimentary alarm clock or an alarm watch awakes the user by an alarm. A more sophisticated radio alarm clock awakes the user by an alarm or the sound of a radio. An alarm clock that integrates with an electronic device, such as a stereo, a television, and a computer, may awake the user by switching on the electronic device or a program within the electronic device. For example, a stereo alarm clock may awake the user with the playing of music from a compact disc (CD) in a CD player, and a television alarm clock may awake the user with the playing of a certain channel. However, these alarm systems base the activation of the alarm time solely on the user-requested alarm time. With the alarm clock style system, the user requests an alarm time by, for example, changing first to an alarm mode and then pressing hour and minute, or + and –, buttons to set the specific user-requested alarm time.

Even though the alarm clock is able to sound an alarm at the user-requested time to signal to the user the wake up time, there are often unexpected conditions that would have made the user change the user-requested time, either to wake up earlier or later, had the user known of their existence or arrival. The unexpected condition(s) may, for example, be simply unknown to the user or have arisen after the user has entered the user-requested alarm time. For example, a significant amount of snow may accumulate overnight, which would require the user to wake up early to shovel it and add to user's travel time to work or school. Rain that would have arrived during the user's commute may also add to user's travel time. A user may also wish to sleep in a little later had he/she known that traffic is lighter than usual on the routes that he/she uses to get to work or school. On the other hand, the user should wake up earlier if the traffic is heavier than usual on the routes that he/she uses to get to work or school. Unexpected conditions may also relate to the arrival/departure time of airplane, bus, train, or other mass-transit transportation vehicles, when the alarm is activated solely or partly because of the need for the user to catch a transportation vehicle or pick someone from a transportation vehicle. Because the alarm clock style system is solely based on a user-requested alarm time, the alarm clock style system is not able to change the time of activating the alarm based on unexpected conditions that may be unknown to the user or have arisen after the use-requested alarm time has been entered. Although the user, in a radio alarm clock system, may conceivably tune the radio to a station that plays primarily a particular type of unexpected condition, such as weather forecasts, traffic reports and flight arrival/departure time, he/she has no means to integrate the unexpected condition information reported in the radio to advance or delay the alarm activation time. Moreover, he/she also has no control over which flight or what region of the country for which a weather forecast or traffics report is being broadcast.

Another type of alarm system is a wake up call service, which may be performed automatically by servers or manually by operators. These services are often available in a hotel or provided by a 1-900 paid telephone service. They usually awake the user with the ringing of a telephone. Oftentimes a short message is also delivered to the user after he/she picks up the phone, such as "this is your wake-up call, and the present time is 6:00 AM." Similarly to the alarm clock style system described above, the wake-up call services are also based only on user-requested time. To set the alarm time, the user calls a receptionist at a hotel or an automated service. With the receptionist, the user tells him/her the time that the user wants to wake-up. With the automated service, the user inputs the user-requested time through a user interface, which may, for example, be a voice recognition system or the telephone dialing pad. Because the automated or personal wake up services are based solely on user-requested time, they suffer from the same defects in that the call back service system is not built to change the time of making the call based on unexpected conditions that may be unknown to the user or have arisen after the use-requested alarm time has been entered.

Therefore, there is a need for a system and method for adjusting an alarm activation time that takes into account of a user-requested alarm time and unexpected conditions that are unknown to the user or arrive after the user has entered the user-requested alarm time. In addition to a wake up alarm, the present invention is applicable to a reminder system that is able to create an alarm signal or a reminder to remind a user of appointments in his/her calendar or date book.

BRIEF DESCRIPTION OF THE DRAWINGS

The accompanying drawings, which are incorporated in and form a part of this specification, illustrate embodiments of the present invention and, together with the description, serve to explain the principles of the present invention.

DETAILED DESCRIPTION

Reference will now be made to the preferred embodiments of the invention, examples of which are illustrated in the accompanying drawings. While the present invention will be described in conjunction with the preferred embodiments, it will be understood that they are not intended to limit the invention to these embodiments. On the contrary, the present invention is intended to cover alternatives, modifications and equivalents, which may be included within the spirit and scope of the invention as defined by the appended claims. Moreover, in the following detailed description of the present invention, numerous specific details are set forth in order to provide a thorough understanding of the present invention. However, the present invention may be practiced without these specific details. In other instances, well-known methods, procedures, components and circuits have not been described in detail as not to unnecessarily obscure aspects of the present invention.

Figure 1:
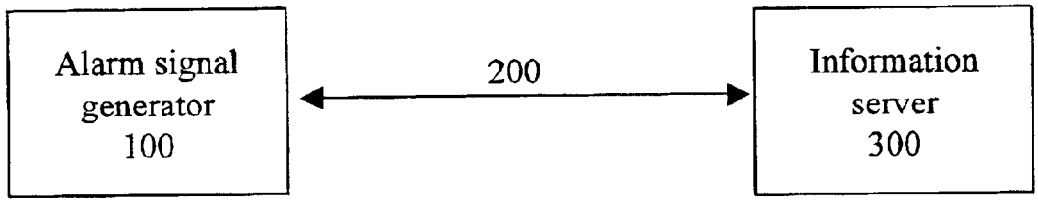
FIG. 1 illustrates an alarm system comprising an alarm signal generator, a communications link and a server according to an embodiment of the present invention.

Embodiments of the present invention are directed to systems and methods for adjusting an alarm signal based upon a user-requested alarm time and an unexpected condition or a set of unexpected conditions. FIG. 1 illustrates an alarm system according to an embodiment of the present invention. The alarm system comprises an alarm signal generator 100, a communications link 200 and an information server 300. The alarm system provides an alarm signal—e.g., an audible, visual, sensory and/or vibration signal—to the user based upon a user-requested alarm time and unexpected conditions that occur after the user has inputted his/her requested time or that are unknown to the user. Examples of such unexpected conditions include traffic condition, weather condition, and the arrival and departure time of airplanes or other vehicles, such as a bus and a train. If an unexpected condition(s) occurs that either delays or advances the user-requested alarm time, an adjusted alarm signal that activates at a time different from the user-requested alarm time is created. In one embodiment, the alarm signal generator 100 allows the user to retrieve information pertaining to the unexpected condition(s). For example, the alarm signal generator 100 may have a display that shows the unexpected condition or an audio system that provides the unexpected information.

Processes to calculate and obtain the adjusted time may be performed mainly at the alarm signal generator 100 or at the information server 300. When the adjusted time is attained primarily based on processing and calculation done at the alarm signal generator 100, information pertaining to an unexpected condition(s) is sent periodically from the information server 300 to the alarm signal generator 100 via the communications link 200. As a result, information pertaining to the unexpected condition(s) is periodically updated at the alarm signal generator 100. In one embodiment, the information may be updated in real time. Every time information pertaining to the unexpected condition(s) is updated, signaling that the unexpected condition(s) has occurred, the time for activating the alarm signal is also updated. Based on whether the unexpected condition(s) delays or advances the user-requested alarm time and the preferences and/or parameters set by the user, the appropriate delay or advancement is calculated and an adjusted alarm time is obtained. If there is no unexpected condition, the alarm signal generator 100 outputs the alarm signal at the user-requested alarm time. If the alarm signal time has been updated, the alarm signal generator 100 outputs the alarm signal at the last updated time.

Instead of having the alarm signal generator 100 mainly responsible for processing and calculating the adjusted time, the information server 300 may be the one primarily responsible, according to an embodiment of the present invention. Compared to an alarm signal generator that is mainly responsible for processing and calculating, the alarm signal generator 100 of this embodiment may be much simpler because only rudimentary functions are needed to be performed. In this case, the user-requested alarm time is first inputted into the information server 300 through the alarm signal generator 100, via the communications link 200. In some instances, the user may input the user-requested alarm time directly into the information server 300 via another communications link, such as through a web site on the Internet. Along with the user-requested alarm time, other user related information, such as the user's location, preferences and parameters, may also be provided to the information server 300. In one embodiment, the other user related information may already be stored at the information server 300 as a result of previous uses by the user, so only user-requested alarm time and account login information are needed.

The information server 300 further has the ability to obtain updated information pertaining to unexpected conditions. For example, the information server 300 may periodically or continuously consult a database(s) that has updated information pertaining to unexpected conditions that are local or pertinent to the user, i.e., those unexpected conditions that would affect the user-requested alarm time. If there is such an unexpected condition(s), the information server 300 calculates an adjusted alarm time by adding the appropriate delay or advancement to the user-requested alarm time, on the basis of the unexpected condition(s) and the preferences/parameters set by the user. When necessary, the time for activating the alarm signal is periodically updated until the time of its activation. When the adjusted alarm time is reached, or the user-requested alarm time is reached if no update is necessary, the information server 300 sends a signal to the alarm signal generator 100 to prompt the generation of an alarm signal. In an alternative embodiment, the information server 300 sends the adjusted alarm time to the alarm signal generator 100 as soon as an update is made at the information server 300. The alarm signal generator 100 receives the adjusted alarm time and uses it to overwrite the alarm time previously stored on the alarm signal generator 100. The overwriting process is continued until the time for activating the alarm signal is reached, at which the alarm signal generator 100 generates the alarm signal.

The alarm system of FIG. 1 may, for example, be embodied in an alarm clock style system that includes an alarm clock device or embodied in an automated call back service. In the former type of the system, the alarm signal generator 100 may, for example, be a normal alarm clock integrated with a receiver, an enhanced or intelligent alarm clock device, or a device that incorporates an enhanced alarm clock, while the information server 300 is a content provider that provides information for unexpected conditions that may affect the alarm activation time. The enhanced alarm clock is an example of an alarm signal generator 100 that is primarily responsible for processing and calculation. In the latter type of the system, the alarm signal generator 100 is in the form of a receiver at a user site, and the information server 300 is in the form of a call back service. The receiver may, for example, be a telephone, a wireless phone, a pager, a text message receiver or a personal digital assistant (PDA). In operation, the call back service makes a phone call to user's phone or sends a signal to user's receiver at either the regular user-requested alarm time or an adjusted time based upon unexpected conditions, such as weather and/or traffic conditions local to the user.

It is noted that reference in the specification to "one embodiment" or "an embodiment" of the present invention means that a particular feature, structure or characteristic described in connection with the embodiment is included in at least one embodiment of the present invention. Thus, the appearances of the phrase "in one embodiment" or "according to an embodiment" appearing in various places throughout the specification are not necessarily all referring to the same embodiment.

Figure 2:
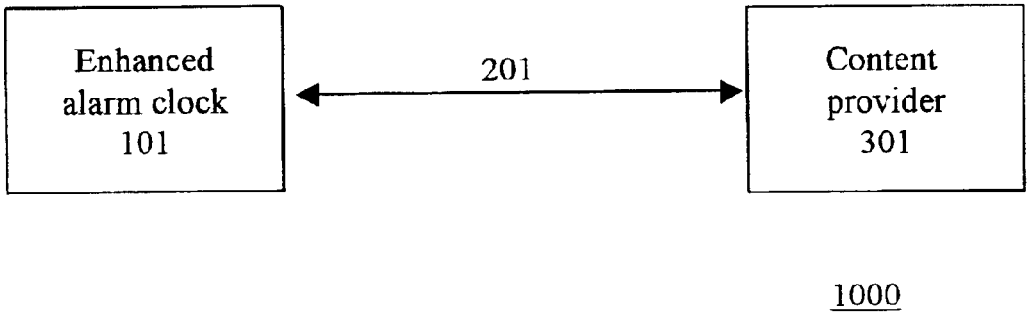
FIG. 2 illustrates an alarm system comprising an enhanced alarm clock, a communications link and a content provider according to an embodiment of the present invention.
Figure 3:
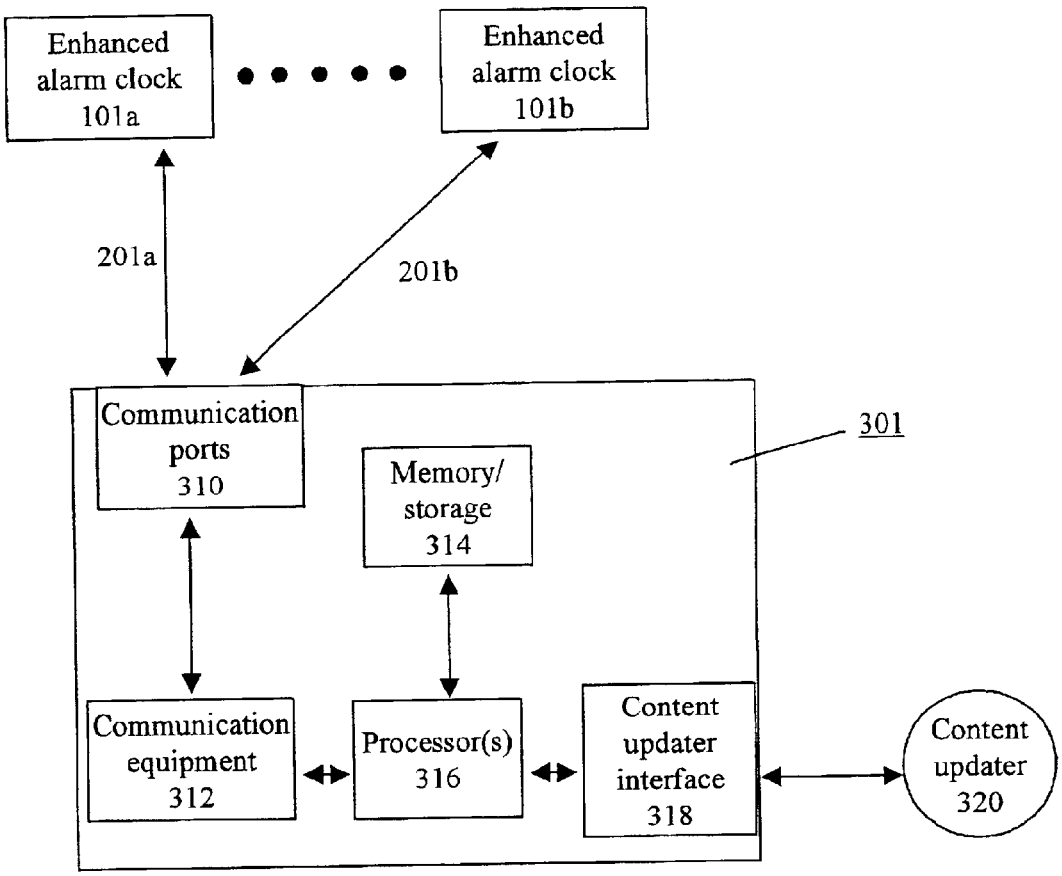
FIG. 3 shows a content provider according to an embodiment of the present invention.

With reference now to FIG. 2, an alarm clock style system according to an embodiment of the present invention is illustrated. The system 1000 comprises an enhanced or intelligent alarm clock 101, a communications link 201 and a content provider 301. The content provider 301 includes sufficient computing resources and serves as a repository and/or server for providing information pertaining to unexpected conditions. The repository and/or server may, for example, have a central or distributed nature. FIG. 3 shows the content provider 301 according to an embodiment of the invention. In the embodiment, the content provider 301 serves a number of enhanced alarm clocks 101*a*, 101*b* via communications links 201*a*, 201*b*. The components of the content provider 301 include communication ports 310, communication equipment 312, memory/storage 314, at least one processor 316 capable of general computation and an interface 318 for communicating with a content updater 320. The communication ports 310 connect the content provider 301 with the communication links 201*a*, 201*b*, which connect to the enhanced alarm clock 101*a*, 101*b*, respectively, at the other end. The communication equipment 312, such as a modem or a network interface, connected to the communication ports 310 allows the content provider 301 to communicate with the enhanced alarm clocks 101*a*, 101*b*, receiving data therefrom and sending data thereto.

The data received from an enhanced alarm clock may, for example, be the location of the user, a travel destination, and/or certain actions of the user. Upon receiving the data, the communication equipment 312 sends the data to the processor 316. The processor 316, along with software and/or programs in the content provider 301, processes the received data. Some of the data are stored in the memory/storage 314, which may include a short term memory and a long term storage. Some of the data are utilized for a query into the content updater 320, through the content updater interface 318, for information pertaining to unexpected conditions. Alternatively, the query may be made to a content database in memory/storage 314, with the content database being updated with information pertaining to unexpected conditions for a number of users on a periodic basis. The content updater interface 318 and the content updater 320 may, for example, be in two different formats. In one format, a manual method that utilizes a keyboard and a monitor for human entry, is provided. In another format, a digital interface, such as a network interface or a modem capable of receiving digital updates or requesting and receiving updates from other sources, is provided.

In response to the query, the content updater 320 provides specific information pertaining to unexpected conditions, which relate to particular users of the enhanced alarm clocks 101*a*, 101*b*, to the content provider 301. The information may, for example, relate weather information to a specific locality, traffic information to specific portions of roadway, airline information related to the delay or advancement of specific flights, and other mass transit information for general delays and/or related to specific routes. The information may be stored in the memory/storage 314, or it may be sent immediately to the enhanced alarm clocks 101*a*, 101*b* in symbolic format used by the enhanced alarm clock 301. In one embodiment, the information in the content provider 301 is updated on a frequent, periodic basis by having the content provider 301 make queries to the content updater 320 periodically. The data originally received from the enhanced alarm clocks 101*a*, 101*b* are used for the periodic queries. If the response received from a subsequent query differs from the response received from the prior query, information pertaining to the unexpected conditions for a particular user of an enhanced alarm clocks is updated. In another embodiment, instead of having the content provider 301 prompting the content updater 320 to receive unexpected condition information, the controlling role is reversed. In this case, the content updater 320 initiates the connection between the two and periodically sends unexpected condition information to content provider 301. The updated information may be transferred to the corresponding enhanced alarm clock if there is a connection between the corresponding enhanced alarm clock and the content provider 301. If no such connection is available, the updated information is stored in the memory/storage 314 until a connection is established at the request of the content provider 301 or at the request of the corresponding enhanced alarm clock.

Figure 4:
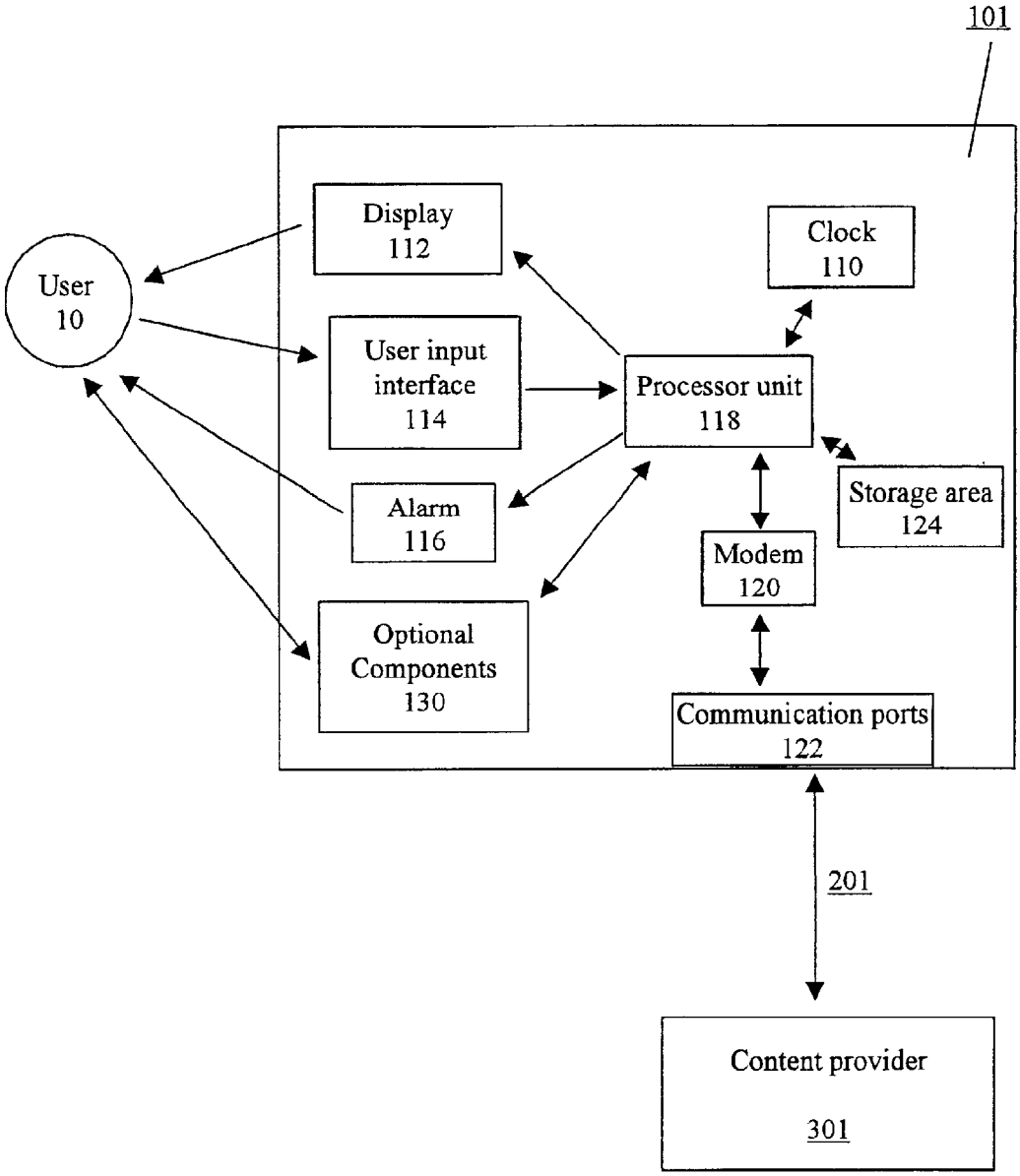
FIG. 4 shows an enhanced alarm clock according to an embodiment of the present invention.

FIG. 4 shows an enhanced or intelligent alarm clock according to an embodiment of the present invention. Also shown in the figure is a user 10 of the enhanced alarm clock 101, a communications link 201 and a content provider 301. The user 10 interacts with the enhanced alarm clock 101 and inputs user-related and configuration information thereto. Examples of the user-related and configuration information include a user-requested time, locations, travel routes, travel destinations, user preferences and delay parameters. In one embodiment, the user may enter a login name-password, which allows the enhanced alarm clock 101 to download the previously stored user's profile or allows the content provider 301 to access the previously stored user's profile. If necessary, the user may edit the user-related and configuration information within the user's profile. Either way, the user-related and configuration information, or a portion thereof, is eventually sent to the content provider 301, if it is not already previously stored therein, for retrieving information pertaining to unexpected conditions.

The communications link 201 is utilized to transfer information between the enhanced alarm clock 101 and the content provider 301. The communications link 200 may comprise communication lines or a wireless connection available at the location of the enhanced alarm clock 101. For example, a direct telephone connection, wireless connection and/or Internet connection may be implemented. This allows a connection to be made between the enhanced alarm clock 101 and the content provider 301, so that user-related and configuration information or user login for invoking such information may be sent to the content provider 301 and information for possible unexpected conditions that may affect the alarm activation time may be sent to the enhanced alarm clock 101. In one embodiment, periodic connections are made between the enhanced alarm clock 101 and the content provider 301. In other embodiments, a real-time connection is made between the two.

As shown in FIG. 4, this illustrative example of the enhanced alarm clock 101 comprises a clock 110, a display 112, user input interface 114, an alarm 116, a processing unit 118, a modem 120, a communication port(s) 122 and a storage area 124. Optional components 130—such as antenna, radio tuner, CD player, speakers, audio input/output ports, video source—with their corresponding parts may also be included in the enhanced alarm clock 101. The display 112 and the user-input interface 114 are more capable than those on a standard alarm clock. For example, the user input interface 114 may be embodied in a user input panel, either being external to the enhanced alarm clock 101 or displayed on the screen, or a voice recognition device/program. The alarm 116 may be able to produce a number of different types of alarm signals, including an audible alarm, a visual alarm and a vibrating alarm. The processor unit 118 is capable of general computation, and it is used to carry out software necessary to support this application and process information received from the content provider 301 based on instructions from the software. The modem 120 may be a variety of communications devices, including a telephone line modem, cable modem, digital subscriber line, wireless modem and/or satellite based systems. Depending on the type of modem utilized, appropriate communication port(s) 122 is used. The storage area 124 may include short term memory and a long term storage.

In operation, a user first configures information at the enhanced alarm clock 101. This may be accomplished by utilizing the display 112 and the user input interface 114. Through the input interface 114, the user is able to input user-related and configuration information to the enhanced alarm clock 101. Alternatively, the user inputs a login name and/or a password to allow previously stored user-related and configuration information to be accessed by the user or downloaded from another source. The display 112 allows the enhanced alarm clock 101 to guide the user through the input session. The user may configure or enter a variety of information, preferences and parameters, including location of the user, destination of the user, normal alarm time, type of unexpected conditions to be taken into account, amount of delay for certain unexpected conditions and the type of signal produced by the alarm.

Depending on the type of unexpected conditions that the user wishes to use, different information is entered. The location of the user may be the user's source name, address, zip code and/or state. The destination of the user may be the user's destination name, address, zip code and/or state. The normal alarm time is the user-requested time, i.e., the time the alarm is activated if there is no unexpected conditions. The type of unexpected conditions to be taken into account by the enhanced alarm clock 101 may include weather information, traffic information, airplane arrival/departure information and other delay information. For each type of the unexpected condition, the user may control the amount of delay based on the intensity of the unexpected condition. For example, the user may associate the typical weather conditions, such as normal/clear, raining, snowing, with the amount of delay for various weather conditions and intensity. The user may also associate the typical traffic delays, such as excessive number of cars or types of accidents, with the amount of effect exerted by the traffic condition. Alternatively, associations may be made between the average speed of the cars traveling on a particular route and the amount of delay. The associations may be used to reduce or exaggerate the effect of the reported delays on the actual alarm time. The user also has the ability to choose the type of signal produced by the alarm, such as visual, audio and electronically/mechanically generated type. Other system parameters and/or preferences may also be customized by the user. For example, the user may enter a specific route(s) that he/she would use when going from his/her source address to his/her destination address. This information is sent to the content provider 301 to override the default routes that the content provider would retrieve using its mapping/direction services, allowing the user to customize to his/her preference.

After all the user-related and configuration information is entered or retrieved, the enhanced alarm clock 101 periodically connects to the content provider 301 to gather information pertaining to unexpected conditions. The frequency of the period may be one of the system parameters to be entered by the user, or a default frequency may be used. In one embodiment, in order to cover busy signals or other inability to communicate on the first attempt by the enhanced alarm clock 101, pseudo-random variation of the frequency is added. Modem 120 and the communication ports 122 are utilized in establishing the connection between the enhanced alarm clock 101 and the content provider 301. A request for connection is sent from the enhanced alarm clock 101 to the content provider 301, which also has communication ports and a modem to receive the request and subsequently establish a connection. The content provider may initiate the connection as well, and in particular, send the enhanced alarm clock 101 periodic updates concerning certain unexpected conditions relevant to the user.

Upon connection to the content provider 301, the enhanced alarm clock 101 provides some of the information from the user-related and configuration information to the content provider 301. For example, the enhanced alarm clock 101 may provide the location of the user and, optionally, a travel destination. The location of the user may be the user's home address and the travel destination may be the user's work address. The processor unit 118 and the program embedded in the enhanced alarm clock 101 work together to extract the necessary information from the storage area 124. Using the modem 120 and the communications ports 122, the information is then sent to the content provider 301 via the communications link 201. The content provider 301 retrieves the relevant information pertaining to current unexpected conditions for the user's location, the travel destination, and/or between the user's location and the travel destination. The retrieved information pertaining to current specific unexpected conditions is then transmitted to the enhanced alarm clock 101.

For example, the retrieved information may be locality based information, i.e., information that is pertinent to the user's location. This includes weather information and traffic information. The weather information may include different conditions, such as rain, snow, fog, sleet hail, high winds, and clear. The weather information may also include different intensity, such as heavy, normal and light. Traffic information may also be retrieved if a travel destination is provided, and the traffic information includes travel delays, accidents, travel restrictions (such as no motorcycles on a bridge), etc. Specific information, such as those related to air arrival and departure delay and cancellation, may also be retrieved. When the information is transferred from the content provider 301 to the enhanced alarm clock 101, the information is in a form appropriate for use by the enhanced alarm clock 101. An illustrative example of the appropriate form is a list of associations. For example, the weather information may be in the form of location and weather type pair, with the location being, for example, a zip code, a city, a county or a region. Additionally, weather intensity and/or default additional delay time may also be associated with the weather type and the weather location. Each type of weather and each different intensity may be configured and associated with a percentage or fixed delay, such that when the enhanced alarm clock 101 processes the associations, specific delay or advancement is added to the user-requested time. Similarly, the traffic example may be in the form of a number of path and additional delay time pairs, with each path being, for example, one of the routes that the user takes to reach the travel destination or a section of the route that the user takes. In addition, average number of cars, type of accident, the severity of the accident, and/or the average speed of the cars on the route, may also be associated with the path, or may be associated in place of the additional delay time. If the associations is made in place of the additional delay time, then the type of accident, the severity of the accident and the average speed and number of the cars on the route may be configured and further associated with a percentage or fixed delay, such that when the enhanced alarm clock 101 processes the associations, specific delay or advancement is added to the user-requested time. Although associations are used to describe the form appropriate for use by the enhanced alarm clock 101, other equivalent or similar forms of organizing information may also be utilized.

The enhanced alarm clock 101 takes the information pertaining to the unexpected conditions and processes it according to the user-related and configuration information entered by the user previously. In one embodiment, preferences and parameters that describe and determine what information to use and/or the amount of delay are included in the user-related and configuration information. The enhanced alarm clock 101 processes the unexpected condition information from the content provider 301 on a periodic basis when an alarm, or user requested time, is set, and determines an adjusted alarm time that factors in the user-related and configuration information. If certain configuration parameters, such as the amount of delay, are not inputted by the user, a default parameter is utilized. The user requested alarm time and the adjusted alarm time may, for example, be stored in the storage area 124, with a later adjusted alarm time updating an earlier adjusted alarm time when necessary. The time indicated by the clock 110 is compared with the adjusted alarm time, or the user requested alarm time if no adjustment is needed. When the clock 110 indicates that the adjusted alarm time has been reached, an audible, visual or mechanical alarm is generated by the alarm 116. In one embodiment, an option on the enhanced alarm clock 101 is provided to allow the user to select a special alarm if the adjusted alarm time is different from the normal alarm time, or the initial user requested alarm time.

Although the above illustrative example for an enhanced alarm clock is described with an alarm clock style device, other type of devices that function, in whole or in part, in a similar fashion may be implemented. For example, a normal alarm clock integrated with a transceiver may be utilized. The transceiver allows the normal alarm clock to send a user requested alarm time to a content provider and to periodically receive an adjusted alarm time from the content provider. In this case, most of the processes for obtaining the adjusted alarm time are carried out at the content provider, with the normal alarm clock activating an alarm signal at the adjusted alarm time, or the user requested alarm time if the normal alarm clock does not receive an adjusted alarm time before the user requested alarm time is reached. In a further example, a black box that essentially functions as either a switch or a remote control that can turn on another device, such as a television or a stereo system, at the adjusted alarm (or "turn-on") time. In another example, a device that incorporates functionality of an enhanced alarm clock may be provided. The device may be a cable box, a television, a PDA, a computer, a pager, a text messenger, a wireless phone, etc. For example, the present invention may be embodied in a wireless PDA or a PDA with a modem attached. In this case, the invention includes software residing in the PDA that processes the user requested alarm time and updates it to an adjusted alarm time when necessary. When a user travels to a new place, he/she may enter the requested time, his/her new location and his/her destination. If the user is on a business trip to visit a customer, the hotel that he/she is staying may be the new location and the customer's location may be the destination. This allows the retrieval of either the adjusted alarm time itself or unexpected condition information that allows adjusted alarm time to be determined.

Figure 5:
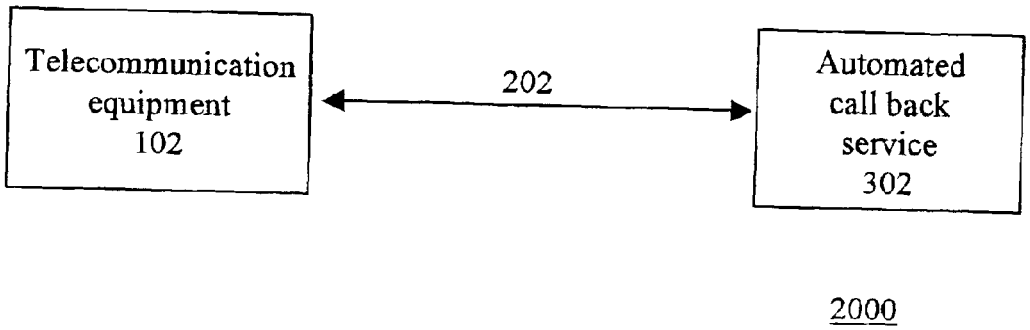
FIG. 5 shows an alarm system comprising a telephone, a communications link and an automated call back service according to an embodiment of the present invention.

With reference now to FIG. 5, a call back service style system according to an embodiment of the present invention is provided. Here, the same basic concept is implemented, with an alarm being activated at an adjusted alarm time based on the user requested (or normal) alarm time and unexpected conditions, such as local traffic and weather. However, the user does not need to own special hardware, such as an enhanced alarm clock or a device integrating the enhanced alarm clock. The call back service style system 2000 comprises telecommunication equipment 102 at a user's end, a communications link 202 and an automated call back service 302. The telecommunication equipment 102 may, for example, be a regular telephone, wireless phone, a pager, a text messenger, and a PDA, a watch, a computer with email or instant message or phone software, or other devices with data receiving capability. The communications link 202 may be wireless based or wired based, and its form is dependent on the type of telecommunication equipment 102 utilized by the user. The automated call back service 302, which is accessed by the user via his/her own telecommunication equipment 102, receives a user requested alarm time, along with other user-related information and/or configuration information, through interactive prompts to the user and/or through historical information kept at the automated call back service 302. Multiple forms of communication are possible. For example, a phone call may be placed, along with an email or an instant message to a computer, allowing a user to access a map or direction, which may be downloaded to a global positioning system application. Besides the user-related and/or configuration information, the automated call back service 302 also receives information pertaining to unexpected conditions. The automated call back service 302 processes the information relevant to the user, information pertaining to unexpected conditions and the user requested alarm time to determine an adjusted alarm time, which may be updated periodically, or in real-time. When the adjusted alarm time is reached, a signal is sent from the automated call back service 302 to the telecommunication equipment 102. In the case of a telephone, a phone call is made.

Figure 6:
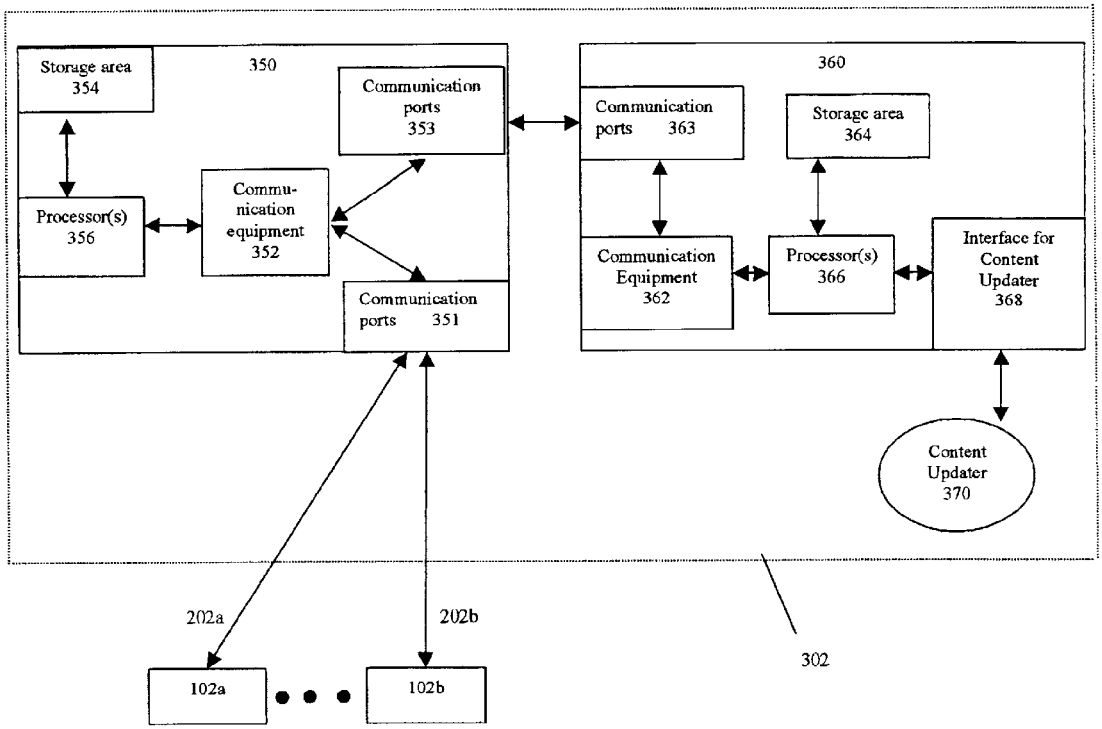
FIG. 6 shows an automated call back service according to an embodiment of the present invention.

FIG. 6 shows the automated call back service 302 according to an embodiment of the present invention. In the embodiment, the automated call back service 302 serves a number of telecommunication equipment 102*a*, 102*b* via communications links 202*a*, 202*b*. The telecommunication equipment 102*a*, 102*b* is in the form of telephones. The automated call back service 302 comprises an alarm request server 350, a content provider 360 and a content updater 370. In one embodiment, the automated call back service 302 may only include the alarm request server 350, with the content provider 360 and the content updater 370 being a separate service that interacts with the automated call back service 302. Inside the automated call back service 302, and in particular, the alarm request server 350, a storage area 354, a processor(s) 356, communication equipment 352, communication ports 351, 353 are provided. Together with software enabling the operation on an automated call back service, they provide equipment capable of storing, processing and retrieving information as well as capable of determining the date, present time and adjusted alarm time. Computer telephony equipment is implemented to perform numerous functions, including receiving multiple incoming calls, processing touch tone and/or voice commands, playing prompts, playing audio information and placing multiple outgoing calls.

In the content providing and updating portion of the automated call back service 302, the content updater 370 and the content provider 360, which comprises communication equipment 362, communication ports 363, a storage area 364, a processor(s) 366 and an interface 368, are provided. Together, the content provider 360 and the content updater 370 provide information pertaining to unexpected conditions that are updated regularly. For example, regularly updated traffic and weather databases may be included. In one embodiment, driving direction software is also provided to allow the automated call back service 302 to determine the routes that a user would take, so that unexpected conditions happening on those routes may be located. Although the alarm request server 350 and the content provider 360 are shown as two separate units, the content provider 360 may be integrated with the alarm request server 350 according to an embodiment of the present invention. In this case, the processor(s) 356 performs functions provided by processor(s) 366, the storage area 354 provides space for data to be stored in the storage area 364, the communication equipment 352 also has the functionality of the communication equipment 362, and the interface for content updater 368 is coupled to the processor(s) 356. In another embodiment, the content provider 360 and/or the content updater 370 is provided by an outside source that is separate from the automated call back service 302.

In operation, the user uses one of the telecommunication equipment 102*a*, 102*b* to place a call to the automated call back service 302. The call is made through the communications link connecting the telecommunication equipment and the communication ports 351 at the automated call back service 302. The communication equipment 352, such as a modem, phone or network interface, connected to the communication ports 351 allows the automated call back service 302 and the user using the telecommunication equipment to establish a connection and interact with each other. While connected, the automated call back service 302 determines various information from control signals accompanying the call, acquired through interactive prompts to the user, or obtained through historical information kept in a database. The various information is similar to the aforementioned user related and configuration information. Software program(s) in the storage area 354 and the processor(s) 356 act together to retrieve the information and, if necessary, search the historical information and provide interactive prompts to the user. For example, the user related and configuration information may include the user-requested alarm/call back time, the user's telephone number, the user's locality information (e.g., address and zip code), the user's destination and the user's desired routes used. The information may include whether to use weather and/or traffic information, amount of delay for various weather conditions and intensity, typical traffic delays and the amount of effect for traffic conditions. Depending on the specifics of the automated call back service system and what is desired by the user, all or a subset of the information is provided to the automated call back service 302. For example, the user's telephone number may be used to determine the location of the user, thus eliminating the need for user's address information.

As the user related and configuration information are provided to the automated call back service 302, they may be stored in the storage area 354. The information that is needed for retrieving unexpected condition information, such as user's location and/or user's destination, is then used to retrieve unexpected condition information from the content providing and updating section of the automated call back service 302. In one embodiment, the information, or a portion thereof, is used to retrieve unexpected condition information being stored in the storage area 354. In the content providing and updating section, the content provider 360 has the responsibility to retrieve unexpected condition information. Selected user related and configuration information, such as the user's location and parameters configured during the user's call, is provided from the alarm request server 350 to the content provider 360, using the communication ports 353 on the alarm request server end and the communication ports 363 on the content provider end. Using a lookup/query program stored in the storage area 364, the processor(s) 366 is able to look up specific information pertaining to unexpected conditions.

Specifically, with the user related and configuration information, the content provider 360 periodically consults the content updater 370 for unexpected conditions that are local to or concern the user. For example, the content provider 360 may contact traffic database and/or weather database within the content updater 370, or the content updater 370 may send updated information from the traffic database and/or weather database to the content provider 360. The current unexpected conditions and parameters/information configured during the user's call are then used to determine the amount of delay or advancement to the user-requested alarm time. For example, based on the location of the user and the destination of the user, the automated call back service 302 determines the routes that the user would use to drive to the destination. An interface may be further provided for editing direction, allowing the user to establish his/her desired routes. The routes are then checked for unexpected traffic conditions, such as accidents, delays, congestion, construction, etc. The average travel speed of cars traveling on the routes may also be determined. For each unexpected traffic condition, the automated call back service 302 calculates the potential delay to add to the user's travel time based on default parameters or parameters set by the user. The parameters may, for example, control the amount of delay for different types of traffic conditions or different average speeds, or control the amount of effect for each traffic condition.

Figure 7:
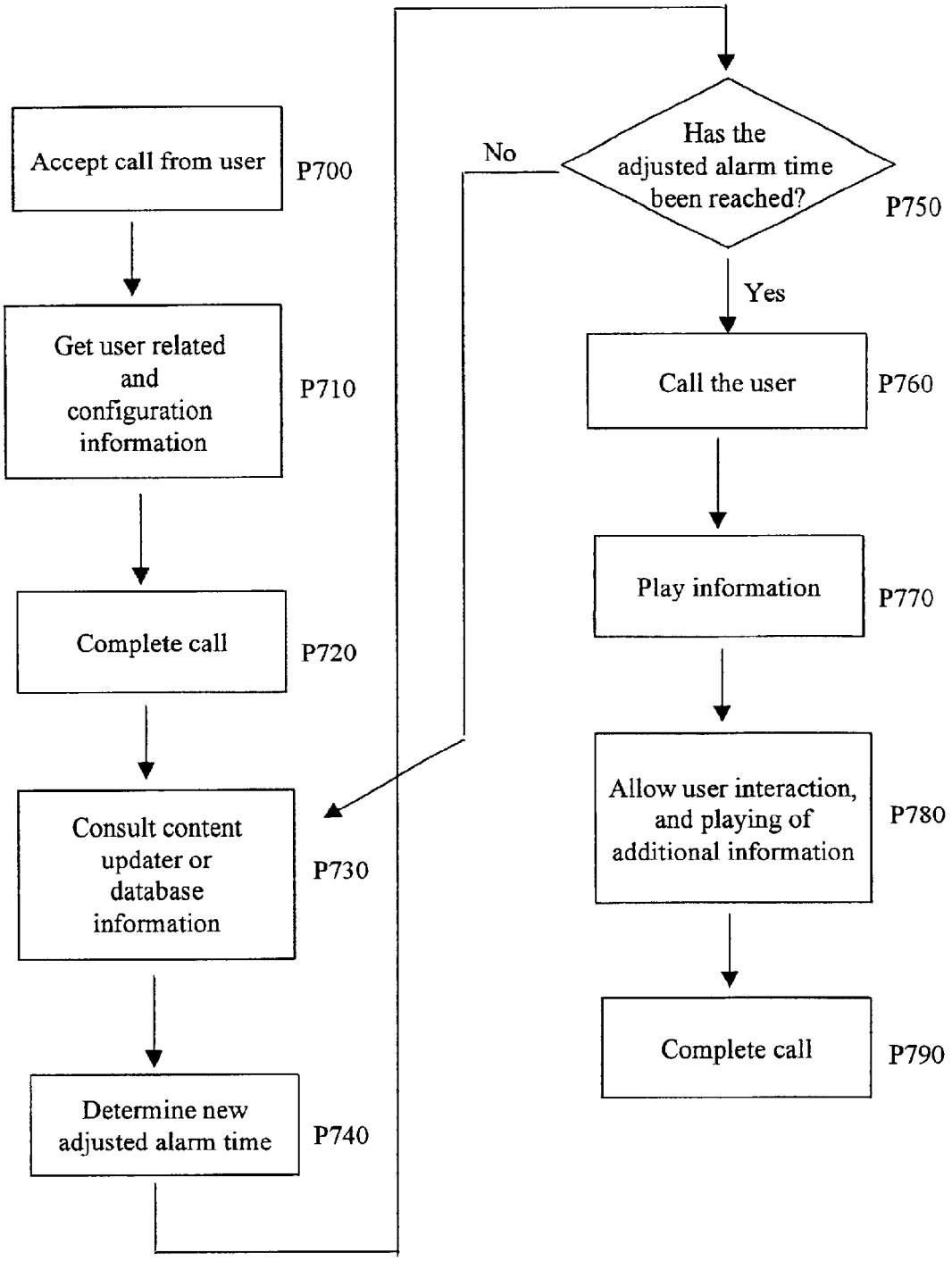
FIG. 7 illustrates a flow diagram showing an exemplary sequence of operation of the automated call back service depicted in FIG. 6.

FIG. 7 illustrates a flow diagram showing an exemplary sequence of operation of an automated call back service depicted in FIG. 6. In block P700, the automated call back service 302 accepts a call from a user. The automated call back service preferably has the capability of receiving multiple incoming calls and processing them separately. In one embodiment, the automated call back service provides prompts to, in turn, receive information that establishes the identity of the user. For example, the user may be asked to enter his/her telephone number or identification number. In another embodiment, the automated call back service 302 recognizes the user by determining the source of the call. For example, if the user uses a telephone to make a call, the automated call back service may use the user's telephone number, which accompanies the phone call, to determine the identity of the user. If the user is identified to be a user that has interacted with the automated call back service 302 before, the automated call back service 302 tries to retrieve user related and configuration information, or a portion thereof, by searching through the user's historical information kept in a database. In one embodiment, the user is asked to answer yes or no questions concerning the user related and configuration information.

Oftentimes, user historical information is not available, such as the case for a new user, or user historical information does not have the desired user related and configuration information, such as the case for an established user that wishes to change certain information. In these cases, the automated call back service 302 provides interactive prompts to the user to retrieve user related and configuration information, as shown in block P710. Examples of user related and configuration information include, but are not limited to, the user's telephone number, user's location, user-requested alarm time, user's destination, user's desired routes, unexpected conditions to be considered, amount of delay for certain unexpected conditions, amount of effect for certain conditions, and other parameters and preferences that are involved in the calculation of the adjusted alarm time. In block P720, once the user-requested alarm time and other user information/parameters/preferences are received, the call is completed.

To retrieve current unexpected condition information local to, or concerning, the user, the automated call back service 302 consults a content updater or database information provided by a content updater, as shown in block P730. The automated call back service 302 provides user related information to the content updater and receives, in return, unexpected condition information from the content updater. For example, the automated call back service 302 may provide user's location to determine local weather information, user's destination and/or user's desired routes to determine traffic information, and flight number to determine changes in flight arrival/departure time. In one embodiment, instead of having periodic connections between the automated call back service 302 and the content updater, a real-time connection is established between the automated call back service 302 and the content updater.

In block P740, the new adjusted alarm time is determined based on the unexpected condition information from the content updater. If there is no unexpected condition that would affect the time for sounding the alarm, an adjusted alarm time is not determined and the user-requested time is used. The automated call back service 302 determines the adjusted alarm time by taking the user-related time and adding appropriate advancement/delay based on the unexpected condition information retrieved in block P730. The extent of the advancement/delay is affected by the parameters/preferences configured during the user's call or retrieved from the user's historical information. If any of the parameters/preferences are not set or configured, the default parameter/preference is used. The parameters/preferences may, for example, determine the kind of unexpected conditions to be considered by the automated call back service 302, specify the delay/advancement for unexpected conditions and affect the amount of delay/advancement for the different kind of unexpected conditions.

With the new adjusted alarm time, the automated call back service 302 determines if the adjusted alarm time has been reached, as shown in block P750. In one embodiment, the automated call back service 302 compares the adjusted alarm time with a clock that has the actual time at the user's locale. The actual time at the user locale is important because the time at the automated call back service 302 may differ from the time at the user's locale because of their being located in different time zones. If it is determined that the adjusted alarm time has been reached, the automated call back service 302 calls the user, as shown in block P760. Assuming that the user is using the telecommunication equipment 102*a*, the call is made from the communication equipment 352, through the communication ports 351 and the communication link 202*a*, to the telecommunication equipment 102*a*. If the telecommunication equipment 102*a* is a telephone or a wireless phone, a phone call is made by the automated call back service 302. If the telecommunication equipment 102*a* is a pager or a text messenger, a page or a text message is made by the automated call back service 302. The telecommunication equipment may also be other type of personal devices, such as a PDA.

On the other hand, if it is determined that the adjusted alarm time has not been reached, the sequence of operation for the automated call back service 302 returns to block P730. In one embodiment, if it or the adjusted alarm time has not been reached but is, however, relatively close to the actual clock time, the automated call back service 302 simply waits for the small amount of time before it calls the user in block P760. Upon returning to block P730, the automated call back service 302 consults the content updater, or database information provided by a content updater, to retrieve unexpected condition information that is current at that time. If there is no change in the unexpected conditions from the last time the automated call back service 302 consulted the content updater, the alarm time is not changed. If the unexpected condition(s) changes to an extent that would affect the time of sounding the alarm, then a new adjusted alarm time is determined, as shown in block P740. The new adjusted alarm time supplants the previous adjusted alarm time, or the user-requested alarm time if no adjusted alarm time is ever calculated. Alternatively, the automated call back service 302 may simply calculate an adjusted alarm time based on the unexpected condition information and the user's parameters/preferences every time it returns to blocks P730 and P740, whether or not the unexpected condition information differs from that retrieved previously. The calculated adjusted alarm time supplants any previous alarm time, be it an old adjusted alarm time or the user-requested alarm time. With the calculated adjusted alarm time, the automated call back service 302 again determines whether the adjusted alarm time has been reached in block P750. In one embodiment, a delay element is introduced between block P750 and block P730, so that the automated call back service 302 periodically consults the content updater for information pertaining to unexpected condition as long as the adjusted alarm time has not been reached in block P750. The length of the period for which the automated call back service 302 consults the content updater then depends on the length of the delay introduced by the delay element.

The automated call back service 302 makes a call to the user's telecommunication equipment 102*a* when the adjusted alarm time has been reached, as shown in block P760. In the example where the telecommunication equipment 102*a* is a telephone or a wireless phone, a phone call will be placed to the user's telephone number, which was obtained by the automated call back service 302 during user's call or the retrieval of the user's historical information. In block P770, when the phone is answered, indication of the purpose of the call will be played, as well as other information that may be desirable to the user. For example, the call may act as an alarm service that calls the user to wake him/her up. When the user answers the call, the present time, the specifics concerning the unexpected conditions, ways to avoid the unexpected conditions may be played to the user. The call may also signal the user that a particular event is about to take place or inform user of time sensitive information. In one embodiment, the automated call back service 302 is synchronized with the user's calendar or user's date book, which contain several user-requested appointment/reminder times. These user-requested appointment/reminder times are adjusted to adjusted appointment/reminder times based on unexpected conditions related to appointment/reminders. When an adjusted appointment/reminder time in the calendar or data book is reached, a reminder call is made from the automated call back service 302 to the user's telecommunication equipment 102*a*.

In block P780, the user has the ability to interact and listen to additional information. For example, the user may be able to retrieve an advertisement(s) that is local to user's location, user's destination, or user's route. The user can interact with the advertisement to receive other information, such as directions to a local breakfast place. The user may also listen to local traffic and weather information, as well as other information pertaining to other kinds of unexpected conditions. In the circumstances where airplane/bus/train departure or arrival time has been changed, the user may request for the changed time. When the user is satisfied with the information, he/she completes the call, as shown in block P790.

Figure 8:
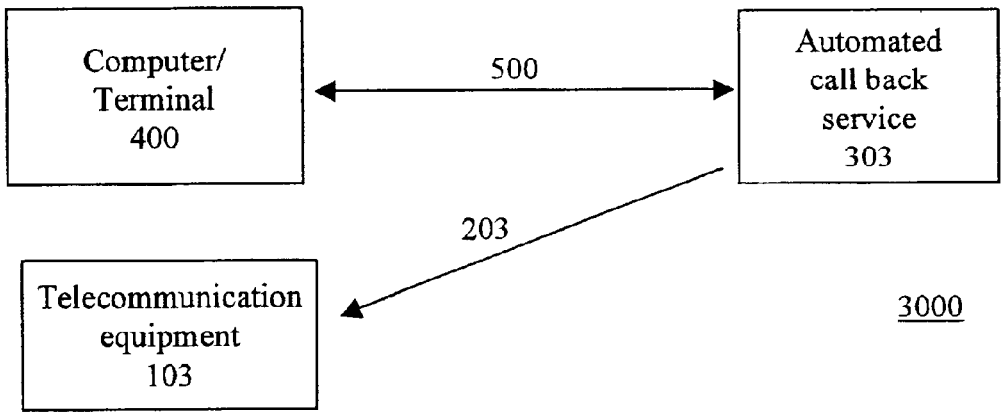
FIG. 8 shows an alarm system comprising a computer, a telephone, communications links and an automated call back service according to an embodiment of the present invention.

Instead of having a user using telecommunication equipment to call the automated call back service 302 and then input user login information and/or user related and configuration information, an alarm system of a call back service style may use other forms of communication. FIG. 8 shows an alarm system that utilizes the Internet according to an embodiment of the present invention. In this example, the Internet represents the other form of communication that the automated call back service utilizes. Other type of communication network may also be utilized in place or in conjunction with the Internet. In the embodiment, the alarm system comprises telecommunication equipment 103 at the user's end, a first communications link 203, an automated call back service 303, a computer or a terminal 400 and a second communications link 500. The first communications link 203 allows connection to be established between the automated call back service 303 and the telecommunication equipment 103, enabling a call to be made form the automated call back service 303 to the telecommunication equipment 103. The second communications link 500 allows connection to be made between the computer/terminal 400 and the automated call back service 303.

In this example, the communications link 500 is the Internet, which the automated call back service 303 uses to collect the user related and configuration information from the computer/terminal 400. The computer/terminal 400 is provided with a user interface for a user to input user related and configuration information. The user interface may, for example, be a keyboard, a touch screen, a voice recognition system, etc. An interactive session may be established between the user and the automated call back service 303, whereby the user uses the computer/terminal 400 to enter user-related and configuration information, such as user-requested alarm time and other parameters/preferences. In addition, the user may also use the computer/terminal 400 to register with the automated call back service 303 or to enter the user's login information, from which the automated call back service 303 determines the user's identity and retrieves user-related and configuration information, or some portions thereof, from a historical information database. The user related and configuration information is made available to the automated call back service 303 for use in computing an adjusted alarm time periodically.

Figure 9:
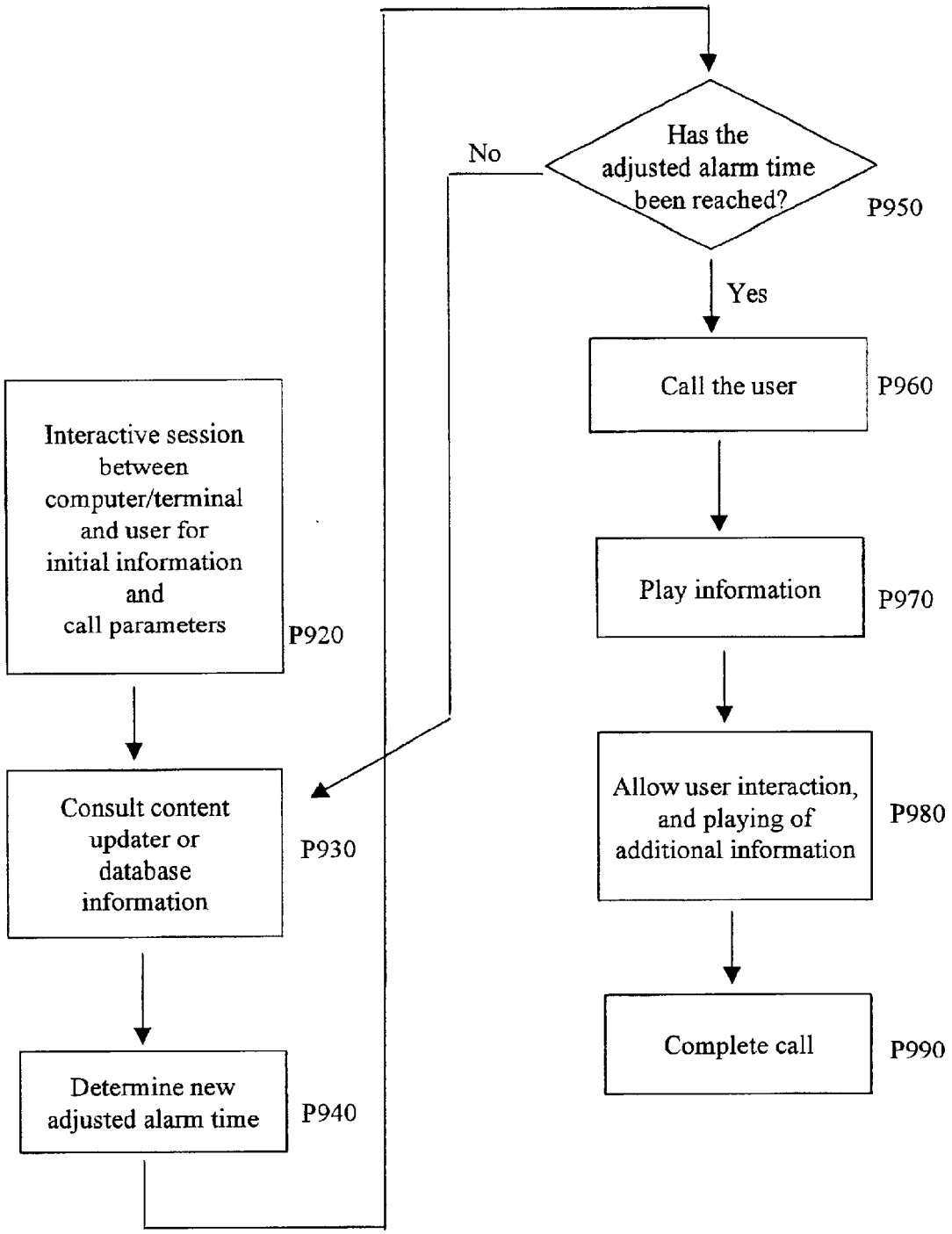
FIG. 9 illustrates a flow diagram showing an exemplary sequence of operation of the automated call back service depicted in FIG. 8.

FIG. 9 illustrates a flow diagram showing an exemplary sequence of operation of the automated call back service 303 depicted in FIG. 8. The sequence of operation is similar to the one shown in FIG. 7, except that blocks P700, P710 and P720 are replaced by P920. Instead of using the telecommunication equipment to input initial information and call parameters, an interactive session is implemented between the user and the automated call back service 303 using the computer/terminal 400 via the Internet. The rest of blocks in FIG. 9 correspond to those in FIG. 7, respectively. For example, block P930 corresponds to block P730. Because Internet access is widespread and the computer/terminal 400 is able to display much information in an organized manner, the alarm clock system depicted in FIG. 8 allows the user to enter user related and configuration information with ease and in a more efficient manner, as compared to, for example, the user using a telephone to enter user related and configuration information.

Figure 10:
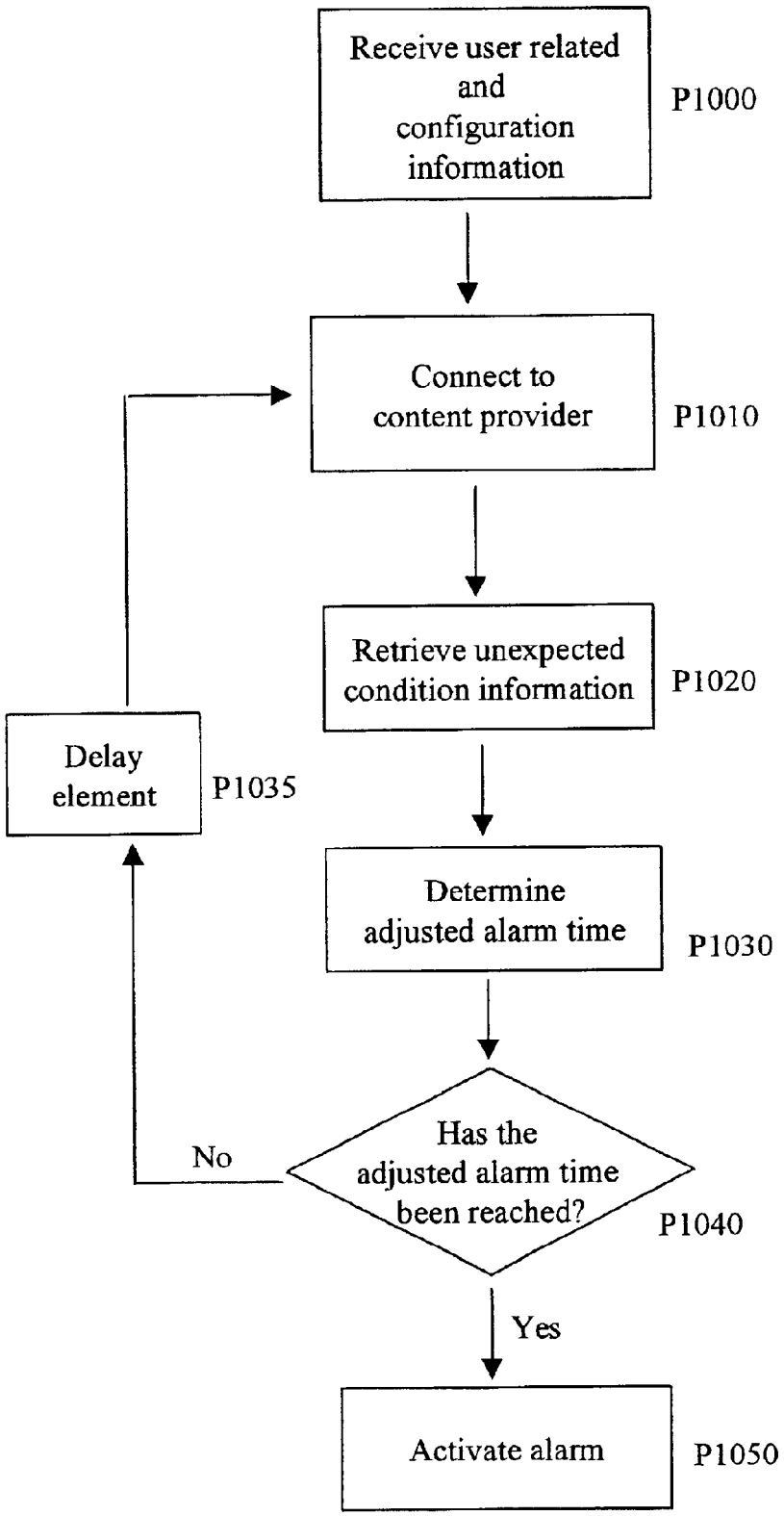
FIG. 10 illustrates process for an enhanced alarm clock style system according to an embodiment of the present invention.

FIG. 10 illustrates process for an enhanced alarm clock style system according to an embodiment of the present invention. The enhanced alarm clock style system comprises an enhanced alarm clock, a communications link and a content provider. In block P1000, the enhanced alarm clock receives user related and configuration information from the user. The user related information may include a user-requested alarm time and other preferences/parameters for calculating an adjusted alarm time. In one embodiment, user login information may be used to allow the enhanced alarm clock to retrieve user related and configuration information previously stored by the user either at the enhanced alarm clock or an outside source. In block P1010, the enhanced alarm clock connects to the content provider, via the communications link, to gather unexpected condition information relevant to the user. The enhanced alarm clock receives the unexpected condition information in block P1020. In block P1030, using the unexpected condition information and the user related and configuration information, an adjusted alarm time is calculated. In block P1040, it is determined whether the adjusted alarm time has been reached. If it has not, the sequence of operation returns to P1010, where the enhanced alarm clock contacts the content provider to retrieve new unexpected condition information. A delay element, shown in block P1035, may be inserted between block P1040 and block P1010 to introduce the amount of delay before the content provider retrieves new unexpected condition information. If the new unexpected condition information differs from the unexpected condition information retrieved in the previous contact, a different adjusted alarm time is then determined to replace the adjusted alarm time determined previously. In some instances, the unexpected condition may turn from a bad condition, which causes delay to the user, to a better or to a normal condition, meaning that the user no longer needs to wake up earlier. In this case, the new adjusted alarm time takes into consideration this fact and delays the alarm activation time accordingly. As such, the enhanced alarm clock connects to the content provider on a periodic basis to obtain the most recent information pertaining to unexpected conditions as long as the adjusted alarm time has not been reached. In block P1050, when the actual time reaches the adjusted alarm time, an alarm in the enhanced alarm clock is activated.

Many advantages are intrinsic to the present invention of providing an enhanced alarm signal generating system or a call back service style system. The time of the alarm, reminder or call is automatically changed based on current unexpected conditions. For example, if an unexpected snowfall were to arrive overnight, the alarm would be activated in advance of a user-requested time, allowing the user to wake up early to shovel the unexpected snowfall, with the intensity or the amount of the snowfall controlling the degree of alarm advancement. If a flight is delayed and the route to the airport is normal, the alarm would be activated after the user-requested time, allowing the user to sleep more or spend time doing other things. Moreover, a user on a business trip is not likely to be acquainted with the local weather and traffic conditions or know the updated flight arrival/departure time. However, with the enhanced alarm clock or the call back service, the user is able to adjust an alarm time or a reminder time for appointment in his calendar according to unexpected conditions. If traffic is lighter than usual, the user is allowed to sleep a little later. If the traffic is heavier than usual, the user is awakened or reminded at an earlier time. According to embodiments of the present invention, the alarm system awakes or reminds the user at the user-requested time under normal conditions, at a time in advance of the user-requested time when there is unexpected condition(s) that causes delay, and at a time after the user-requested time when there is unexpected condition(s) that gives user more time than usual. Specifically, the time advance or delay introduced to the user-requested time to form an adjusted alarm time is dependent on the type and severity of the unexpected condition(s) as well as the parameters/preferences initialized by the user. This allows the user to maximize his/her time while avoiding being late to his/her destination.

While the foregoing description refers to particular embodiments of the present invention, it will be understood that the particular embodiments have been presented for purposes of illustration and description. They are not intended to be exhaustive or to limit the invention to the precise forms disclosed. For example, although only one alarm clock generator and one information server are shown in FIG. 1, the information server may serve a number of alarm clock generators and/or an alarm clock generator may be served by a number of information servers. Moreover, the processor unit and the software within an enhanced alarm clock may be replaced with logic blocks in whole or in part. The logic blocks may take the user-requested time and unexpected conditions as inputs and output an adjusted alarm time, or the logic blocks may determine if an alarm time, either a user-requested alarm time or an adjusted alarm time, has been reached. Besides providing a simple alarm signal to the terminal, as data is periodically collected, the data may be digitally transmitted to an external-computing device. The external-computing device may use the information for any suitable purpose, but preferably to provide a similar service. Many modifications and variations are possible in light of the above teachings and may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A method for providing an adjustable alarm system, the method comprising:

receiving user related and configuration information, the user related information including a user-requested alarm time and user login information, the user login information allowing retrieval of the user-requested alarm time, and at least one of parameters or preferences that relate different intensity levels of an unexpected condition to the amount of alarm adjustment;

connecting to a content provider to gather present unexpected condition information relevant to the user;

determining an adjusted alarm time, wherein the adjusted alarm time factors in the user related and configuration information and the unexpected condition information; and providing an alarm signal when the actual time reaches the adjusted alarm time.

2. The method of claim 1, wherein the connection is made to the content provider on a periodic basis to gather the most recent unexpected condition information, and the adjusted alarm time is determined on a periodic basis based on the user related and configuration information and the most recent unexpected condition information.

3. The method of claim 1, wherein the user login information allows the retrieval of user-requested alarm time and at least one of other user related information or other user configuration information based on historical information obtained in a previous use by a user.

4. The method of claim 1, wherein the user related information includes at least one of a user's location, a user's destination, user's preferred routes and user related flight or mass-transit information.

5. The method of claim 4, wherein the user's location and the user's destination are utilized to determine the routes that a user uses to travel from the location to the destination.

6. The method for claim 1, the at least one of parameters and preferences that specify the amount of alarm adjustment for certain unexpected conditions.

7. The method of claim 1, wherein a special alarm is activated when the adjusted alarm time differs from the user-requested alarm time.

8. The method of claim 1, wherein the unexpected condition information relates to traffic information, including at least one of accidents, delays, average speed, congestion, construction and travel restrictions.

9. The method of claim 1, wherein the unexpected condition information relates to weather information, including at least one of snow, rain, fog, sleet hail and high winds.

10. The method of claim 1, wherein the unexpected condition information relates to delay or advancement of at least one of mass-transit arrival time and mass-transit departure time.

11. The method of claim 1, wherein the alarm signal includes at least one of an audible, visual, sensory and vibration signal.

12. A computer readable medium for use in conjunction with an alarm system for providing an adjustable alarm signal, the computer readable medium including computer readable instructions encoded thereon for:

receiving user related and configuration information, the user related information including a user-requested alarm time and user login information, the user login information allowing retrieval of the user-requested alarm time, and the user configuration information includes at least one of parameters and preferences that relate different intensity levels of an unexpected condition to the amount of alarm adjustment;

connecting to a content provider to gather present unexpected condition information relevant to the user;

determining an adjusted alarm time, wherein the adjusted alarm time factors in the user related and configuration information and the unexpected condition information; and providing an alarm signal when the actual time reaches the adjusted alarm time.

13. The computer readable medium of claim 12, wherein the user configuration information includes at least one of parameters and preferences that control the amount of effect for certain unexpected conditions.

14. The computer readable medium of claim 12, wherein a special alarm is activated by the enhanced alarm clock when the adjusted alarm time differs from the user-requested alarm time.

15. The computer readable medium of claim 12, wherein the unexpected condition information relates to traffic information, including at least one of accidents, delays, average speed, congestion, construction and travel restrictions.

16. The computer readable medium of claim 12, wherein the unexpected condition information relates to weather information, including at least one of snow, rain, fog, sleet hail and high winds.

17. The computer readable medium of claim 12, wherein the unexpected condition information relates to delay or advancement of at least one of mass-transit arrival time and mass-transit departure time.

18. The computer readable medium of claim 12, wherein the alarm signal includes at least one of an audible, visual, sensory and vibration signal.

19. An enhanced alarm signal generating system, comprising:

an alarm signal generator that receives user related and configuration information and create an alarm signal, the user related information including a user-requested alarm time and user login information, the user login information allowing retrieval of the user-requested alarm time;

a content provider to gather present unexpected condition information relevant to the user; and a communications link the connects the alarm signal generator with the content provider, wherein user related information is sent to the content provider via the communications link to gather the unexpected condition information, an adjusted alarm time being determined on the basis of the user related and configuration information and the unexpected condition information, and an alarm signal being created when the actual time reaches the adjusted alarm time, and wherein, the unexpected condition information is kept at, and the adjusted alarm time is determined by, equipment remote from the alarm signal generator.

20. The enhanced alarm signal generating system of claim 19, wherein the user configuration information includes at least one of parameters and preferences that specify the amount of alarm adjustment for certain unexpected conditions.

21. The enhanced alarm signal generating system of claim 19, wherein the user configuration information includes at least one of parameters and preferences that relate different intensity levels of an unexpected condition to the amount of alarm adjustment.

22. The enhanced alarm signal generating system of claim 19, wherein the user configuration information includes at least one of parameters and preferences that control the amount of effect for certain unexpected conditions.

23. The enhanced alarm signal generating system of claim 19, wherein the alarm signal is a special alarm when the adjusted alarm time differs from the user-requested alarm time.

24. The enhanced alarm signal generating system of claim 19, wherein the alarm signal includes at least one of an audible, visual, sensory and vibration signal.

25. The enhanced alarm signal generating system of claim 19, wherein the alarm signal generator is any one of a normal alarm clock integrated with a receiver and a processor, an enhanced alarm clock device, and a device that incorporates an enhanced alarm clock.

26. A call back style alarm system, comprising:

a call back service that receives user related and configuration information, and determines an adjusted alarm time, the user related information including a user-requested alarm time and user login information, the user login information allowing retrieval of the user-requested alarm time;

a content updater coupled to the call back service, the content updater gathering present unexpected condition information relevant to the user;

a telecommunication device that receives a call from the call back service; and a communications link that connects the call back service with the telecommunication device during a call, wherein user related and configuration information of the user is received at the call back service, which uses the user related information to obtain unexpected condition information pertinent to the user from the content updater, the adjusted alarm time being determined on the basis of the user related and configuration information and the unexpected condition information, a call being made to the telecommunication device when the actual time reaches the adjusted alarm times; wherein the user configuration information includes at least one of parameters and preferences that relate different intensity levels of an unexpected condition to the amount of alarm adjustment.

27. The call back style alarm system of claim 26, wherein the user related and configuration information is entered through the telecommunication device during a call.

28. The call back style alarm system of claim 26, further comprising a terminal that provides user related and configuration information to the call back service, wherein the terminal is provided with an inputting interface for a user to enter user related and configuration information.

29. The call back style alarm system of claim 26, wherein the unexpected condition information is gathered on a periodic basis to receive the most recent unexpected condition information, and the adjusted alarm time is determined on a periodic basis based on the user related and configuration information and the most recent unexpected condition information.

30. The call back style alarm system of claim 26, wherein the user login information allows the retrieval of user-requested alarm time and at least one of other user related information or other user configuration information based on historical information obtained, in a previous use by a user.

31. The call back style alarm system of claim 26, wherein the user configuration information includes at least one of parameters and preferences that specify the amount of alarm adjustment for certain unexpected conditions.

32. The call back style alarm system of claim 26, wherein the user configuration information includes at least one of parameters and preferences that control the amount of effect for certain unexpected conditions.

33. The call back style alarm system of claim 26, wherein the call is made in a different mode when the adjusted alarm time differs from the user-requested alarm time.

34. The call back style alarm system of claim 26, wherein the telecommunication device is any one of a telephone, a wireless phone, a pager, a text messenger, a computing device and a personal digital assistant.

* * * * *